United States Patent [19]

Lazcano-Navarro et al.

[11] Patent Number: 4,537,629

[45] Date of Patent: Aug. 27, 1985

[54] METHOD FOR OBTAINING HIGH PURITY DUCTILE IRON

[75] Inventors: Arturo Lazcano-Navarro; Miguel A. Alcantara, both of Saltillo, Mexico

[73] Assignee: Instituto Mexicano de Investigaciones Siderurgicas, Saltillo, Mexico

[21] Appl. No.: 642,256

[22] Filed: Aug. 20, 1984

[51] Int. Cl.[3] ..... C22C 33/08

[52] U.S. Cl. ..... 75/130 R; 75/51.2; 75/51.6

[58] Field of Search ..... 75/52, 59, 60, 130 R

[56] References Cited

U.S. PATENT DOCUMENTS

| | | | |
|---|---|---|---|
| 16,082 | 11/1856 | Bessemer | 75/60 |
| 4,329,171 | 5/1982 | Robert | 75/60 |
| 4,365,992 | 12/1982 | Sieckman | 75/60 |
| 4,411,697 | 10/1983 | Spenceley | 75/60 |
| 4,430,117 | 2/1984 | Spenceley | 75/60 |

*Primary Examiner*—Peter D. Rosenberg
*Attorney, Agent, or Firm*—Laurence R. Brown

[57] ABSTRACT

A method for making high quality liquid iron with substantially no residual chemical elements and a controlled content of carbon, manganese, phosphorous, sulfur and silicon in the final metal. Sponge iron, as raw material, is melted in a vessel or converter with a basic refractory lining. The energy required for melting the sponge iron is provided by the exothermic reaction of carbon from any coal or carbonaceous material and oxygen in solution within the metal bath and by the combustion of other hydro-carbon fluids, all injected to the bath through nozzles preferably located in the bottom of the converter. Further energy is obtained with the post-combustion of gases leaving the metal bath when ascending to the upper port of the converter. Alloy additions might be made by injection in order to obtain a liquid bath chemical composition which permits that the final liquid metal be used as starting material with excellent properties for the fabrication of high quality iron, particularly ductile iron, which has a very stringent condition for reaching desired properties. Specifically important is the chemical analysis of the metal bath before solidification of the final cast piece. Final liquid metal from the converter can be solidified in form of small ingots for easy further handling. These ingots are excellent as starting material for ductile iron fabrication.

11 Claims, 1 Drawing Figure

METHOD FOR OBTAINING HIGH PURITY DUCTILE IRON

BACKGROUND OF THE INVENTION

In the production of ductile iron, a furnace of induction or cupola type is charged normally with 50% scrap returns of ductile or other iron from the plant, 48% of selected steel scrap and 2% graphite for carbonization. Depending on availability, pig iron scrap might be charged, and the final product quality will be a function of the raw material.

The above mentioned raw materials charging practices for the production of ductile iron are disadvantageous to obtain a uniform and sufficiently high product quality due to the inconsistency of the chemical analysis of the charge.

For producers of ductile iron, the ideal raw material is an iron of convenient and highly uniform chemical composition, free of residual elements which bring secondary detrimental effects on the microstructure and properties of the final products. Additionally, if the iron is handled in its solid phase, it is economically advantageous to do it with the optimum weight and geometry for its transportation, handling, charging to the furnace and melting conditions where the ductile iron is to be produced.

The proposed method for fabricating low residual iron metal avoids systematically the introduction of tramp elements brought by the initial scrap charge.

More specifically, microstructure and properties are affected by zinc, lead, arsenic, bismuth and cadmium which deteriorate the morphology of the graphite modules and favor the formation of flakes or vermicular graphite.

Other critical residual elements such as molybdenum, chromiun, boron, etc. result in the formation of detrimental carbides requiring an extra final heat treatment for the cast piece, as is the case in many foundries.

The above mentioned aspects concern with the starting material involved in the production of a high quality iron, particularly ductile iron whose chemical analysis and condition in liquid phase before solidification, are critical for the proper microstructure and final mechanical properties.

Also microstructure (particularly nodules morphology and consequent properties), can be affected by improper inoculation procedures.

In common processes for making ductile iron, normally, liquid iron to be transformed into ductile iron is tapped either from a cupola furnace or an induction furnace and some times from an electric furnace.

These processes have advantages and disadvantages; the induction furnace is very useful in making ductile iron but in any form the raw material analysis is in essence inherited to the final product. It is possible to charge high quality starting scrap to reach in the induction furnace the critical condition of liquid bath for making ductile iron. For instance, It is possible to charge small ingots produced by the method herewith proposed, in which the basic raw material is sponge iron; but sponge iron could not be charged directly into the induction furnace since up to date it has not been possible to handle the slag produced in the smelting of sponge iron.

The cupola furnace follows the same behavior regarding the inheriting effect from raw material, however it is possible to get an excellent liquid for making high quality ductile iron by a very drastic control in raw materials. Furthermore, the cupola furnace operation and product quality also depend on the coke properties (size and uniformity). In case of low availability of high quality coke, this presents an obstacle for making high quality ductile iron. A cupola furnace can be charged with sponge iron or prereduced pellets for improving the chemical analysis, but again it fails to reach a good condition in operation, as pellets fall through the coke bed making the operation erratic. Also, as in the case of the induction furnace, the increasing slag makes it difficult to remove it after certain limits of slag volume produced.

The method for producing controlled chemical analysis liquid iron herewith proposed, overcomes the mentioned problems and permits the production of high quality ductile iron. In the proposed method, the process for iron bearing materials melting is carried out in a converter vessel and therefore it is possible to handle a high slag volume. As self sufficient in energy it is also possible to melt all the charge from prereduced iron in any form. Regarding specific requirements for energy source as is the case of special coke for the cupola, the proposed process is more flexible as it injects any solid carbonaceus materials in form of fines therefore not depending on certain materials such as coke. All conventional methods for producing ductile iron have inoculation as a common problem due to the volatile properties of magnesium. In the present process, magnesium is injected through the bottom of the converter, which increases the efficiency of inoculation.

SUMMARY OF THE INVENTION

It is a primary object of this invention, to provide a method for making high quality iron with control of chemical analysis and substantially no residual elements, particularly important for the fabrication of nodular iron, using sponge iron as raw material of iron bearing units, and carbonaceous material in form of solid fines to provide the energy for melting and controlling the final carbon in the melt.

Significative advantages over other conventional processes are implied due to flexibility in process control and raw material uniformity and cleanliness regarding tramp elements.

The principle used in the production of iron with no tramp elements, consists of the melting of sponge iron by the heat released in the reaction between oxygen and carbon within the metal bath and also possibly between oxygen and carbon monoxide in the atmosphere of a converter, close to the metal bath surface contained in such converter. The oxygen and carbon fines are preferably introduced into the metal bath by injection through nozzles properly designed for this purpose.

Injection of alloys and particularly magnesia is carried out through the bottom nozzles in order to perform a much better inoculation compared to conventional processes.

DESCRIPTION OF THE PREFERRED EMBODIMENT

Figure 1:
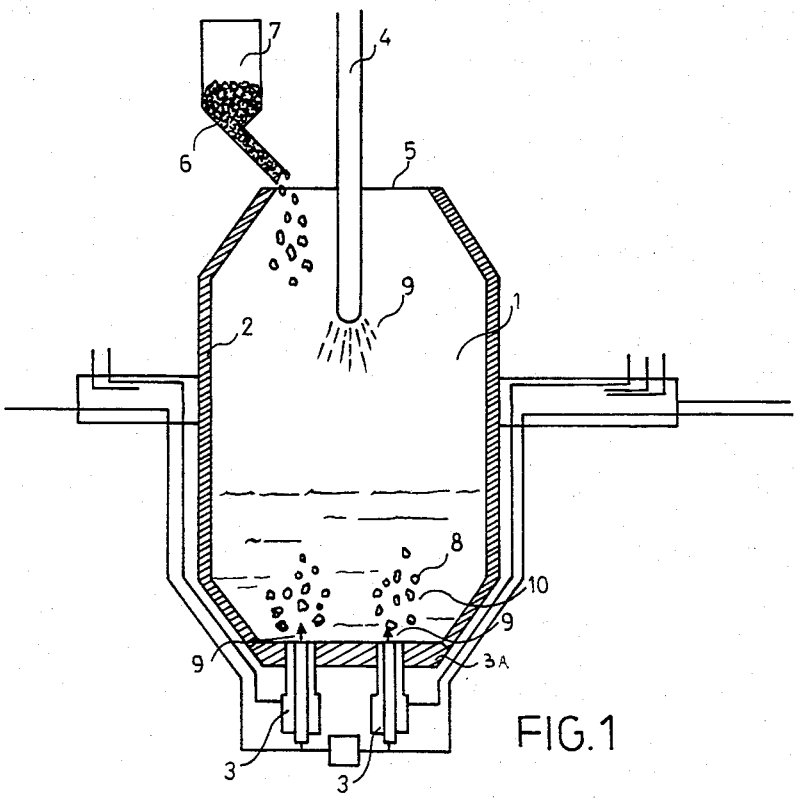
FIG. 1 shows a vertical view partly in cross section of a converter in which the process of melting solid prereduced iron is done by injecting oxygen and carbonaceus material through the bottom of the converter.

In the process to obtain a liquid iron with controlled chemical analysis, a converter of the type of Basic Oxygen Furnace or Q-BOP is used for melting sponge iron which might have the following analysis (typical): 2% C, 0.075%P, 0.018% S, 2.4% CaO, 2.4% $SiO_2$, 0.7% MgO, 1.2% $Al_2O_3$, 16.6% FeO and the balance is metallic iron. In melting this iron bearing material, no tramp elements are brought to the melt as virgin metal is produced.

FIG. 1 shows a converter (1), with basic refractory (2) having injection nozzles (3) at the bottom (3 A) of converter (1) and a lance (4) introduced through the mouth (5) of said converter. The sponge iron is added to the vessel as pellets or lumps (6) through a discharge bin located at the top (7) of the structure in which converter (1) is located. Sponge iron fines (8) might also be introduced as fines injected through the nozzles (3) at the bottom (3 A) of the converter using a carrier gas.

The process starts by introducing sponge iron by any of the mentioned forms to the vessel which initially contains a small amount of liquid iron. The oxygen (9) and coal fines (10) are then injected through the nozzles (3) located in the bottom (3 A) exothermically to produce CO. This reaction takes place between the oxygen and carbon in solution in the liquid bath.

The heat released by the above reaction plus the heat obtained by the post-combustion of CO to $CO_2$ when oxygen is injected through the lance at the top provide the required energy to fully reduce and melt the sponge iron charged into the converter.

The chemical and thermal evolution of the process can be described as follows: when the oxygen and coal fines are injected into the liquid bath, these elements go into solution and react to form CO by the mechanisms described; the sponge iron is charged at a rate such that the heat generated by the system is used in the heating and melting of the sponge iron, until the capacity of the converter is reached. Said capacity is defined by a specific volume parameter (vol. of the vessel)/ (ton. of liquid metal). During the process, the sponge iron melts into liquid iron and the gangue (oxides already present in the sponge iron) floats out to the slag while the coal fines provide carbon which goes into solution in the liquid metal; the ash is absorbed by the slag, and CO, $CO_2$, $H_2$, etc., are produced by the reaction with oxygen and decomposition of the volatile matter.

The chemical analysis of the liquid metal will be a function of the chemical analysis of the raw materials and of the physycochemical evolution followed by the process in terms of injection parameters and special additions for refining. By using sponge iron as the raw material, the elements which take part in the process are limited to iron, carbon, manganese, sulfur, silicon and phosphorus.

Due to the nature of the process, the contents of carbon, silicon, manganese and phosphorus can be controlled to a high degree of accuracy through the oxidation of said elements with the oxygen injected. The oxidation products of manganese, silicon and phosphorus are taken to the slag and the oxidation products of carbon, CO and later $CO_2$ leave the bath as bubbles. The phosphorus is fixed to the slag by the reaction of its oxide with lime which is injected as fines through one or more bottom nozzles.

In case that further oxidation is required, say to lower the phosphorus content in the bath to the required level, the carbon content is also decreased by injecting more oxygen and decreasing carbon injection. In order to obtain the required carbon content in the bath at the end of the cycle process, it is carburized by injecting coal fines until the final carbon content is reached.

This possibility of injecting carbon fines enables the process to control carbon content in the bath with high accuracy and efficiency in terms of carbonaceus material utilization. If necessary and according to the specific final grade of metal to be made, manganese and silicon can be adjusted by oxidation or addition of ferroalloys of these elements in the bath. During some periods of the process, lime is injected in form of fines through the nozzles, (3) in order to control the slag basicity and fix the phosphorous in the slag. Also the elimination of sulphur from the bath is accomplished by the introduction of lime.

The lime injection rate is controlled according to the evolution of the process so as to get the proper basicity. Sulphur content in the bath can be critical, as sulphur content of carbonaceus materials injected is usually high. In this regard several alternatives or combination of steps can be taken, as for instance, to remove a first slag formed with lime injection and then the formation of a second slag with injection of lime and/or compounds developed for desulphurizing as soda ash, calcium carbide, mangnesia, etc.

For instance, in desulphurising the slag resulting from sponge iron decomposition, carbonaceus material injected and lime injected might accomplish a sulphur removal from the bath to slag in the order of 60%. This slag is first removed and a second slag formed as above mentioned accomplishing a high final desulphurization of the bath. These compounds can be injected with propane, metane gas or some hydro-carbon gas. In this way a secondary slag is obtained for a sufficient desulphurization.

Once the metal is ready, inoculation can be carried out by bottom injection of magnesium bearing material; this way inoculation effectiveness improves, final microstructure is more consistent and nodules obtain a proper shape.

The final liquid metal is tapped from the converter for continuing the treatment process for producing nodular iron. The final cast piece or alternatively liquid metal can be poured into small ingot molds for producing solid ingots of controlled chemical composition that can be easy to transport and handle for further utilization in the production of nodular iron in different installations.

In the frame of application of the material product of the proposed method, a nodular iron systematically produced by the said method, will have uniformity and consistency in every cast piece, and because of the mentioned control in chemical analysis no detrimental graphites are formed by mentioned graphitizers elements and toughness properties are improved with no extra heat treatment as is the case in many instances.

By the injection of magnesium in any form, the inoculation process is improved, since magnesium enters in intimate contact with metal at the bottom of the converter.

What we claim is:

1. The method for obtaining high purity ductile iron comprising the steps of using sponge iron as a raw material, and melting it to form a molten bath in a basic lining converter by the energy of an external reaction between carbon and oxygen injected into the metal bath through nozzles extending through the converter lining.

2. The method of claim 1 including the step of adding materials for the composition of the ductile iron through the nozzles.

3. The method of claim 1 including the step of agitating the molten iron by injection through the nozzles.

4. The method of claim 1 including the step of innoculating the iron with magnesium.

5. The method of claim 4 wherein the innoculation is carried out after the iron is purified.

6. The method of claim 1 including the step of innoculating carbon fines in the molten iron through said nozzles.

7. The method defined in claim 1 including the steps of floating gangue and ash on the molten iron and removal of the gangue in the form of slag.

8. The method defined in claim 6 including the step of fixing of phosphorous to the slag.

9. The method defined in claim 1 including the step of injecting lime fines into the molten bath to produce a predetermined basicity.

10. The method defined in claim 1 including the steps of forming a first slag with injection of desulphurizing ingredients, removing the slag, and forming a second slag with injected desulphurization ingredients to finalize desulphurization.

11. The method defined in claim 1 including the steps of tapping molten metal from the bath and casting as small ingots.

* * * * *